US005882229A

United States Patent [19]

Caren et al.

[11] Patent Number: 5,882,229

[45] Date of Patent: Mar. 16, 1999

[54] FUSE TAP

[75] Inventors: Barry L. Caren, Beverly Hills, Calif.; Norman E. Cook, Mooresville, N.C.

[73] Assignee: Magnadyne Corporation, Compton, Calif.

[21] Appl. No.: 766,302

[22] Filed: Dec. 13, 1996

[51] Int. Cl.[6] ..... H01R 13/68

[52] U.S. Cl. ..... 439/621

[58] Field of Search ..... 439/621, 622

[56] References Cited

U.S. PATENT DOCUMENTS

| | | | |
|---|---|---|---|
| 3,126,242 | 3/1964 | Herman | 339/62 |
| 4,372,638 | 2/1983 | Sohler | 339/273 |
| 4,830,631 | 5/1989 | Hsueh | 439/622 |
| 4,884,050 | 11/1989 | Kozel | 337/264 |
| 4,941,851 | 7/1990 | Hsueh | 439/621 |
| 4,943,248 | 7/1990 | Colleran et al. | 439/850 |
| 4,986,767 | 1/1991 | Kozel | 439/621 |
| 5,324,214 | 6/1994 | De Castro | 439/621 |
| 5,476,396 | 12/1995 | De Castro | 439/692 |

FOREIGN PATENT DOCUMENTS

WO 96/05990 2/1996 WIPO .

OTHER PUBLICATIONS

1994 –Sound Quest, Inc. –Catalog p. 52.

1996 –Magnadyne –Catalog p. 33.

*Primary Examiner*—Gary F. Paumen

*Attorney, Agent, or Firm*—Brooks & Kushman P.C.

[57] ABSTRACT

A fuse tap for a blade fuse is disclosed which includes a tap flange to which a blade of the blade fuse is received. The blade is retained within the opening by a plurality of teeth which exert a clamping force on opposite sides of the blade. A locking element is formed on the tap to lock the tap onto the blade fuse. A crimp connector is formed on one end of the tap which is adapted to be secured to a wire by crimping. The fuse tap is formed as a unitary one-piece body formed by bending a single blank of metal to provide the crimp connector on one end and the tap flange formed at the other end which includes an opening for receiving the blade of the blade fuse.

10 Claims, 1 Drawing Sheet

FUSE TAP

TECHNICAL FIELD

The present invention relates to fuse taps for blade fuses.

BACKGROUND OF THE INVENTION

Blade fuses have been broadly accepted for use in vehicle electrical systems. Blade fuses generally include a pair of parallel blades which are partially retained within a plastic fuse body so that a portion of each blade extends from the fuse body. The portions of the blade extending from the fuse body are designed to be received in a fuse block. The fuse block is typically located in the glove box, under the hood or in another readily accessible location.

Automotive aftermarket electronic devices such as alarm systems, CD changers, navigation systems, keyless entry systems, cell phones and audio devices are frequently designed to be powered by the vehicle electrical system. Professional installers and consumers are understandably hesitant to cut the wires of a vehicle to tap into the vehicle's electrical system. In many instances, it is difficult to run wires to tap the battery directly.

Various devices have been developed to tap into the vehicle electrical system using the blade fuses. One example of a blade fuse power tap is disclosed in U.S. Pat. No. 4,986,767 which discloses a connector for tapping power from a flat blade miniature plug-in fuse including a clamp that is adapted to engage the top portion of a fuse. The device includes a screw used to provide an electrical connection to the fuse and also connect the clamp to the top portion of the fuse. One problem which this device is that it extends considerably above the top of the fuse and may interfere with closing a fuse block cover. In addition, the device requires dexterity in assembling the clamp and screw to the blade fuse.

Another example of an electrical terminal for a bladed fuse is disclosed in U.S. Pat. No. 4,943,248 which discloses an electrical connector for connecting an automotive fuse to another circuit member. This device does not provide a secure locking arrangement and may also suffer from a disadvantage in that if there is any oxidization between the contact blade and the U-shaped contact structures, the electrical connection may be adversely affected.

Another example of a blade terminal tap fuse is disclosed in U.S. Pat. No. 4,884,050 which discloses a miniature fuse which includes an extended blade element provided on one blade of the fuse which extends through the upper portion of the body of the fuse. Following this approach, the fuse provided by the vehicle manufacturer must be discarded and replaced by the blade terminal tap fuse. An installer must maintain an inventory of tap fuses which correspond to the proper ampere rating fuses to be replaced.

This invention is directed to solving the above problems and others as will become apparent to one of skill in the art in view of the following summary and description of the invention.

SUMMARY OF THE INVENTION

It is an object of the present invention to provide a fuse tap which is simple to apply to original equipment fuses.

It is also an object to provide a durable fuse tap which is resistant to corrosion due to the secure connection between the fuse tap and the fuse blade.

It is another object to provide a fuse tap which locks onto the fuse in a secure manner that is not loosened by vehicle vibration.

It is one object to provide a fuse tap which is inexpensive to manufacture and can be formed from a single piece of metal by blanking and bending the single piece of metal.

It is another object of the invention to provide a fuse tap that does not require an additional terminal connector to complete the installation of the fuse tap.

According to another aspect of the invention, a fuse tap is disclosed for a blade fuse having a pair of substantially parallel blades that are partially retained in a plastic fuse body with contact portions of each blade extending from the fuse body. The contact portions are adapted to be received in a fuse block. The fuse tap of the present invention comprises a body which is connected to an electrical conductor at one portion of the body. A tap flange is formed on the body which has an opening defined in the flange for receiving the contact portion of one of the blades of the blade fuse. A plurality of teeth are formed on the opening which securely engages the contact portion of the blade.

According to another aspect of the invention, the teeth are formed on opposite sides of the opening in the tap flange and extend in a distally convergent direction away from the fuse body when placed on a blade fuse. First and second sets of teeth engage first and second oppositely facing sides of the blade. The first and second sets of teeth are displaced outwardly upon insertion of the blade so that the teeth exert a resilient clamping force on opposite sides of the blade.

According to a further aspect of the invention, a locking element is formed on the body of the fuse tap at a predetermined distance from the tap flange corresponding to the dimension of the fuse body through which the blades extend.

In accordance with the invention, the fuse tap preferably includes a crimp connector which is adapted to be secured to an electrical conductor such as a wire by crimping the wire within the crimp connector.

According to an aspect of the invention relating to its manufacturer, a fuse tap for a blade fuse as previously described is provided as a unitary one-piece body formed by bending a single blank of metal wherein a crimp connector is formed on one end of the body that is adapted to be secured to a wire by crimping the connector to the wire and a tap flange is formed at another end of the body having an opening defined therein for receiving the contact portion of one of the blade fuse blades.

According to another aspect of the invention relating to its manufacture, the tap flange includes spring biased contact elements that are formed adjacent the opening which are oriented to grip the contact portion of the blade. The spring biased contact elements are also preferably formed integrally from the single blank of metal.

According to a further aspect of the invention and its manufacture, a locking element is preferably formed on the body at a predetermined distance from the tap flange which corresponds to the dimension of the fuse body through which the blades extend in a parallel direction. The locking element is preferably formed from the same blank of metal as the crimp connector and the tap flange.

These and other objects and advantages of the present invention will be better understood in view of the attached drawings and the following detailed description of a preferred embodiment of the invention.

DETAILED DESCRIPTION OF THE INVENTION

Figures 1, 2, 3:
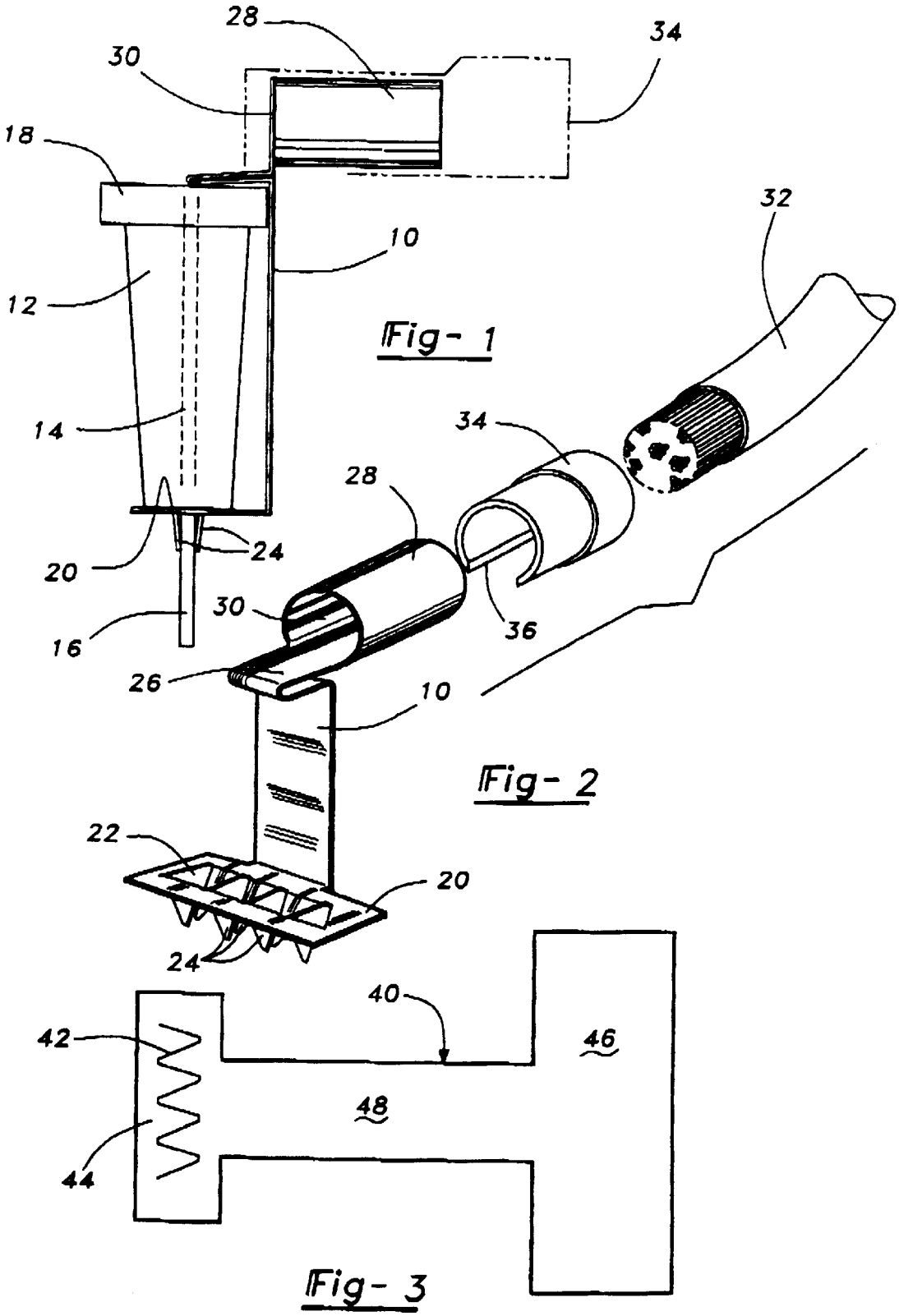
FIG. 1 is a side elevation view of a fuse tap made in accordance with the present invention shown attached to a blade fuse.
FIG. 2 is a perspective view of the fuse tap made in accordance with the present invention.
FIG. 3 is a plan view of a blank for making a fuse tap in accordance with the present invention.

Referring now to FIGS. 1 and 2, the fuse tap 10 of the present invention is illustrated. In FIG. 1, the fuse tap 10 is assembled to a blade fuse 12. Blade fuse 12 includes two substantially parallel blades 14. Blades 14 include a contact portion 16 which extends outwardly from one end of the fuse body 18. Blades 14 also extend through the fuse body 18 from the lower portion of the fuse body as viewed in FIG. 1.

Fuse tap 10 has a tap flange 20 in which an opening 22 is formed. Opening 22 is adapted to receive a contact portion 16 of one of the blades 14. A plurality of pointed teeth 24 are formed around the opening 22. The teeth 24 converge relative to the contact portion 16 of the blades 14 and extend away from the fuse body 18 when the blade fuse 12 is secured to the fuse tap 10. The teeth 24 are formed of a resilient metal such as copper, brass or aluminum so that when the teeth 24 are placed over the contact portion 16 they are flexed outward so that a resilient clamping force is applied by the teeth 24 on the contact portion 16 of the blades 14.

A locking lip 26 is formed on the fuse tap 10 by forming a reverse bend on the fuse tap 10 at a predetermined distance from the tap flange 20. The distance between the tap flange 20 and the locking lip 26 is selected to correspond to the dimension of the fuse body 18 parallel to the direction that the blades 14 extend through the fuse body 18. The blade fuse 12 is inserted in the fuse tap 10 by first inserting the contact portion 16 of a blade 14 through the opening 22. When the fuse body 18 contacts the tap flange 20, the locking lip 26 is moved over the top of the fuse body 18 as viewed in FIG. 1, thereby capturing the fuse body 18 between the tap flange 20 and the locking lip 26.

A crimp connector 28 is provided on the fuse tap 10 as shown in FIGS. 1 and 2. Crimp connector 28 is a generally cylindrical member defining an opening 30 in which a wire 32 may be inserted for connection to the fuse tap 10. The crimp connector is split to facilitate making a crimp connection whereby the walls of the crimp connector 28 defined in the opening 30 may be crimped on the wire 32.

A plastic insulator 34 is provided on the crimp connector to provide an insulative cover over the crimp connector. Insulator 34 has a notch 36 which facilitates fitting the insulator over the locking lip 26.

Referring now to FIG. 3, a blank 40 for forming the metal portions of the fuse tap 10 from a unitary one-piece blank of metal is shown. The blank 40 includes a teeth cut 42 formed in a tap flange blank portion 44 at one end of the blank 40. On the other end of the blank 40, a crimp connector blank portion 46 is formed. The crimp connector blank portion 46 is formed into a semi-cylindrical shape to form the crimp connector. A body strip 48 interconnects the tap flange blank portion 44 and the crimp connector blank portion 46. The body strip 48 is bent to include a 180° bend forming the locking lip 26 at the juncture of the crimp connector blank 46 and the body strip 48.

It will be readily appreciated by one of ordinary skill in the art that the above description of the invention may be modified and that the preceding description is intended by way of example and not by way of limitation. The scope of the present invention should be construed in accordance with the following broad claims.

What is claimed is:

1. A fuse tap for a blade fuse having a pair of substantially parallel blades partially retained in a fuse body with a contact portion of each blade extending from the fuse body, the contact portions being adapted to be received in a fuse block, wherein the fuse tap comprises:

a body, said body being connected to an electrical conductor at one portion thereof; and a tap flange formed on the body and having an opening defined therein for receiving the contact portion of one of the blades, wherein at least one tooth is formed on the opening which is adapted to securely engage the contact portion; and a locking element is formed on the body at a predetermined distance from the tap flange corresponding to the dimension of the fuse body through which the blades extend in a parallel direction.

2. A fuse tap for a blade fuse having a pair of substantially parallel blades partially retained in a fuse body with a contact portion of each blade extending from the fuse body, the contact portions being adapted to be received in a fuse block, wherein the fuse tap comprises:

a body, said body being connected to an electrical conductor at one portion thereof; and a tap flange formed on the body and having an opening defined therein for receiving the contact portion of one of the blades; and wherein first and second sets of teeth are formed on opposite sides of the opening and extend in a distally convergent direction away from the fuse body when placed on the blade fuse, said blade having first and second oppositely facing sides which are contacted by the first and second sets of teeth respectively.

3. The fuse tap of claim 2 wherein the first and second sets of teeth are adapted to be displaced outwardly by insertion of the blade and the teeth exert a clamping force on opposite sides of the contact portion of the blade.

4. The fuse tap of claim 2 wherein a crimp connector is formed on one end of the body and secured to the electrical conductor, the electrical conductor comprising a wire to which the crimp connector is secured by crimping the connector to the wire.

5. A fuse tap for a blade fuse having a pair of substantially parallel blades partially retained in a fuse body with a contact portion of each blade extending from the fuse body, the contact portions being adapted to be received in a fuse block, wherein the fuse tap comprises:

a body having a connector formed on one end of the body and being adapted to be secured to a wire;

a tap flange formed at another end of the body and having a opening defined therein for receiving the contact portion of one of the blades; and wherein a locking element is formed on the body at a predetermined distance from the tap flange corresponding to the dimension of the fuse body through which the blades extend in a parallel direction.

6. The fuse tap of claim 5 wherein spring biased contact elements are formed adjacent the opening defined in the tap flange and oriented to grip the contact portion of said one blade.

7. The fuse tap of claim 6 wherein said spring biased contact elements are formed from a single blank of metal.

8. The fuse tap of claim 5 wherein the locking element is formed from said single blank of metal.

9. The fuse tap of claim 5 wherein the crimp connector is provided with an insulating plastic sleeve.

10. A fuse tap for a blade fuse having a pair of substantially parallel blades partially retained in a fuse body with a contact portion of each blade extending from the fuse body, the contact portions being adapted to be received in a fuse block, wherein the fuse tap comprises:

a body, said body being connected to an electrical conductor at one portion thereof; and a tap flange formed on the body and having a opening defined therein for receiving the contact portion of one of the blades, wherein at least one tooth is formed on at least one side of the opening which is adapted to securely engage the contact portion, said at least one tooth being formed from the tap flange as the opening is formed and extending into the opening, said at least one tooth being flexed outwardly by the contact portion of one of the blades to apply a resilient clamping force on the contact portion.

* * * * *